US009372470B2

(12) United States Patent
Yamada et al.

(10) Patent No.: US 9,372,470 B2
(45) Date of Patent: Jun. 21, 2016

(54) APPARATUS FOR DETECTING AN ABNORMAL CIRCUMSTANCE AT A CONNECTION BETWEEN THE APPARATUS AND AN ATTACHED DETACHABLE UNIT

(71) Applicant: KONICA MINOLTA, INC., Chiyoda-ku (JP)

(72) Inventors: Yohei Yamada, Hino (JP); Toru Kasamatsu, Toyokawa (JP); Mikiyuki Aoki, Toyohashi (JP); Kouei Cho, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/573,645

(22) Filed: Dec. 17, 2014

(65) Prior Publication Data

US 2015/0177681 A1 Jun. 25, 2015

(30) Foreign Application Priority Data

Dec. 20, 2013 (JP) ..... 2013-264320

(51) Int. Cl.
*G03G 21/16* (2006.01)
*G03G 15/08* (2006.01)
*G03G 15/00* (2006.01)

(52) U.S. Cl.
CPC ..... *G03G 21/1652* (2013.01); *G03G 15/0863* (2013.01); *G03G 15/553* (2013.01)

(58) Field of Classification Search
CPC ..... G03G 21/1652; G03G 15/0863; G03G 15/553
See application file for complete search history.

(56) References Cited

U.S. PATENT DOCUMENTS 5,485,342 A * 1/1996 Sugino ..... B41J 29/387 361/104
6,104,888 A * 8/2000 Kobayashi ..... G03G 21/1875 399/12
6,483,995 B2 * 11/2002 Iwaki et al. ..... 399/12
6,701,096 B2 3/2004 Arai et al.
7,212,750 B2 * 5/2007 Kawai ..... G03G 15/55 399/12
8,155,558 B2 * 4/2012 Noh ..... G03G 15/553 399/110
2002/0164169 A1 * 11/2002 Arai ..... B41J 2/17546 399/12

FOREIGN PATENT DOCUMENTS

JP H06-214455 A 8/1994
JP 11-143304 A 5/1999
JP 2003-021991 A 1/2003
JP 2003-241589 A 8/2003
JP 2010-217540 A 9/2010

OTHER PUBLICATIONS

Office Action (Notice of Grounds of Rejection) mailed on Dec. 15, 2015, by the Japanese Patent Office in corresponding Japanese Patent Application No. 2013-264320, and an English Translation of the Office Action. (9 pages).

* cited by examiner

*Primary Examiner* — Francis Gray
(74) *Attorney, Agent, or Firm* — Buchanan Ingersoll & Rooney PC

(57) ABSTRACT

The apparatus includes first and second terminals, an electrical conductor placed around at least the second terminal, a first current applying unit, an abnormal circumstances determining unit, a second current applying unit, and an informing unit. The first current applying unit applies current between the first terminal and the second terminal. The abnormal circumstances determining unit determines whether there is an abnormal circumstance at the connection between the apparatus and the unit side circuit, under the condition that the current is applied by the first current applying unit. The second current applying unit applies current between the first terminal and the second terminal, in case that the abnormal circumstances determining unit determined that there is not an abnormal circumstance of the connection. The informing unit informs the abnormal circumstance of the connection, in case that the abnormal circumstances determining unit determined that there is the abnormal circumstance of the connection.

16 Claims, 14 Drawing Sheets

FIG.5

| CONNECTION STATE | DETECTION RESULT AT PORTION IN1 |
|---|---|
| NO ABNORMALITY | DETECTED |
| UNIT UNLOADED | GND |
| CONNECTION A ABNORMITY | GND |
| CONNECTION B ABNORMITY | GND |

FIG.9

| CONNECTION STATE | DETECTION RESULT AT PORTION IN1 | DETECTION RESULT AT PORTION IN3 |
|---|---|---|
| NO ABNORMALITY | DETECTED | DETECTED |
| UNIT UNLOADED | GND | GND |
| CONNECTION A ABNORMITY | GND | GND |
| CONNECTION B ABNORMITY | GND | DETECTED |
| CONNECTION C ABNORMITY | DETECTED | GND |

FIG.12

| CONNECTION STATE | DETECTION RESULT AT PORTION IN1 | DETECTION RESULT AT PORTION IN3 | DETECTION RESULT AT PORTION IN4 |
|---|---|---|---|
| NO ABNORMALITY | DETECTED | DETECTED | DETECTED |
| UNIT UNLOADED | GND | GND | DETECTED |
| CONNECTION A ABNORMITY | GND | GND | GND |
| CONNECTION B ABNORMITY | GND | DETECTED | DETECTED |
| CONNECTION C ABNORMITY | DETECTED | GND | DETECTED |

APPARATUS FOR DETECTING AN ABNORMAL CIRCUMSTANCE AT A CONNECTION BETWEEN THE APPARATUS AND AN ATTACHED DETACHABLE UNIT

This application is based on Japanese Patent Application No. 2013-264320 filed with the Japan Patent Office on Dec. 20, 2013, the entire content of which is hereby incorporated by reference.

BACKGROUND OF THE INVENTION

1. Field of the Invention

This invention relates to an apparatus attaching a unit. More specifically, this invention relates to an apparatus equipped with a detachable unit.

2. Description of the Related Art

An image forming apparatus, for example a MFP (Multi-function Peripheral), is equipped with a detachable unit for consumables (a consumable unit), for example a toner bottle, an imaging unit, a photo conductor, a developing device or the like. When the consumable unit reaches the end of life which is predetermined (for example, a life time, and a durability criterion of the number of prints), the consumable unit should be replaced with a same type new consumable unit. To determine whether the consumable unit reaches the end of life or not, a conventional image forming apparatus has a function for detecting the amount of the consumable unit use, a function for detecting an attachment (equipment) of a new consumable unit to the image forming apparatus, and a function for determining whether the consumable unit is appropriately installed on the image forming apparatus or not.

When the conventional image forming apparatus determined that the consumable unit is appropriately loaded on the image forming apparatus, the image forming apparatus determines whether the loaded consumable unit is new or old (used one) by detecting electrically the melting and blowing state of a fuse installed on the circuit board in the consumable unit. More specifically, when the fuse melted and blew, the conventional image forming apparatus determines that the consumable unit is old one. On the contrary, when the fuse does not melt, the conventional image forming apparatus determines that the consumable unit is new one and makes the fuse melt and blow.

For example, documents 1 and 2 below disclose a technique distinguishing between an old consumable unit and a new consumable unit installed, by detecting electrically the melting and blowing state of the fuse installed on the circuit board in the consumable unit.

Document 1 below discloses an image forming apparatus having a measuring means for measuring the operating time of an exchangeable component which has an electrical current blocking means. The image forming apparatus comprises a conduction state detecting means, a reserve means, a comparing means, a new one determining means, and a measuring control means. The conduction state detecting means detects the conduction state in the electrical current blocking means at a prescribed timing. The reserve means reserves the detected electrical voltage levels. The comparing means compares the electrical voltage level detected by the conduction state detecting means at the next timing and the electrical voltage level reserved. The new one determining means determines that a new replaceable component is loaded, in case that the electrical voltage level detected is the same as that of a new component, on the result of the comparing. The new one determining means determines that the same replaceable component is loaded, in case that the electrical voltage level detected is not the same as that of a new component and is the same as that of the electrical voltage level reserved, on the result of the comparing. The measuring control means resets the measured value of the measuring means and blocks the electrical current in the electrical current blocking means, in case that the apparatus determines that the new replaceable component is loaded, based on the result of the new one determination.

Document 2 below discloses a unit detection apparatus having a unit which includes a unit side circuit, and a main body of an image forming apparatus which includes a main body side circuit. The unit side circuit has a fuse and a first resistor which is parallely connected to the fuse. The main body side circuit includes a power supply, a first circuit, a second circuit, a detector, and a melt and blow circuit. The first circuit has a second resistor being connected to the power supply via the unit side circuit, when the unit is loaded on the main body of the image forming apparatus. The second circuit has a third resistor and a switching device being series-connected to the third resistor. The second circuit is parallely connected to the second resistor. The detector detects the electrical voltage or electrical current at the prescribed location in the first circuit. The melt and blow circuit turns the switching device off during the predetermined period and melts and blows the fuse, in case that the circuit determines that the fuse in the unit side circuit does not melt and not blew, based on the detecting result of the detector.

Document 1: Japan Patent Publication No. 2010-217540

Document 2: Japan Patent Publication No. (Hei) 11-143304

However, the conventional image forming apparatus has a problem that the new or old determination result of a consumable unit is less reliable. More specifically, in case that an abnormal circumstance (a short circuit) occurs at a connection part between the circuit board of the image forming apparatus side and the circuit board in the consumable unit, the fuse may mistakenly melt and blow by electrical voltage applied for detecting the melting state of the fuse. In particular, a sheet metal plate may be installed around a contact point of the circuit board of the image forming apparatus, to suppress static electric noise. In this case, when the contact point deformed etc., a short circuit is likely to happen at the connection part between the circuit board of the image forming apparatus side and the circuit board in the consumable unit. In consequence, the image forming apparatus may mistakenly determine that the new consumable unit is old, after recovering from the abnormal circumstances.

SUMMARY OF THE INVENTION

The object of this invention is to provide a reliable apparatus being equipped with a unit.

An apparatus, according to one aspect of this invention, attaching a detachable unit equipped with a unit side circuit including a fuse, comprises: first and second terminals; an electrical conductor placed around at least of the second terminal; a first current applying unit to apply current between the first terminal and the second terminal via the unit side circuit, so that first electrical current which can not make the fuse melt and blow flows in the fuse; an abnormal circumstances determining unit to determine whether there is an abnormal circumstance at the connection between the apparatus and the unit side circuit, based on the electrical potential or electrical current at the second terminal, under the condition that the current is applied by the first current applying unit; a second current applying unit to apply current between the first terminal and the second terminal via the unit side circuit, so that second electrical current which can make the fuse melt and blow flows in the fuse, in case that the abnormal circumstances determining unit determined that there is not an abnormal circumstance of the connection; and an informing unit to inform the abnormal circumstance of the connection, in case that the abnormal circumstances determining unit determined that there is the abnormal circumstance of the connection.

A method of controlling an apparatus, according to another aspect of this invention, attaching a detachable unit equipped with a unit side circuit including a fuse, the apparatus comprises first and second terminals; and an electrical conductor placed around at least of the second terminal, the method comprises the processes to: apply current between the first terminal and the second terminal via the unit side circuit, so that first electrical current which can not make the fuse melt and blow flows in the fuse; determine whether there is an abnormal circumstance at the connection between the apparatus and the unit side circuit, based on the electrical potential or electrical current at the second terminal, flowing current between the first terminal and the second terminal, so that the first electrical current flows in the fuse; apply current between the first terminal and the second terminal via the unit side circuit, so that second electrical current which can make the fuse melt and blow flows in the fuse, in case that there is not an abnormal circumstance of the connection; and inform the abnormal circumstance of the connection, in case that there is the abnormal circumstance of the connection.

A non-transitory computer-readable recording medium, according to another aspect of this invention, encoded with a control program for an apparatus, the apparatus attaches a detachable unit equipped with a unit side circuit including a fuse, the apparatus comprises first and second terminals; and an electrical conductor placed around at least of the second terminal, and the control program is configured to cause a computer to execute the processes to: apply current between the first terminal and the second terminal via the unit side circuit, so that first electrical current which can not make the fuse melt and blow flows in the fuse; determine whether there is an abnormal circumstance at the connection between the apparatus and the unit side circuit, based on the electrical potential or electrical current at the second terminal, flowing current between the first terminal and the second terminal, so that the first electrical current flows in the fuse; apply current between the first terminal and the second terminal via the unit side circuit, so that second electrical current which can make the fuse melt and blow flows in the fuse, in case that there is not an abnormal circumstance of the connection; and inform the abnormal circumstance of the connection, in case that there is the abnormal circumstance of the connection.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 5 shows a table indicates the relationship between the connection states of control circuit board 1 and distinguishing circuit board 80 and the signal input to inputting portion IN1, when controlling under the first controlling condition, according to the first embodiment of this invention.

FIG. 9 shows a table indicates the relationship between the connection states of control circuit board 1 and distinguishing circuit board 80 and the signals input to each of inputting portions IN1 and IN3, when controlling under the first controlling condition, according to the second embodiment of this invention.

FIG. 12 shows a table indicates the relationship between the connection states of control circuit board 1 and distinguishing circuit board 80 and the signals input to each of inputting portions IN1, IN3 and IN4, when controlling under the first controlling condition, according to the third embodiment of this invention.

DESCRIPTION OF THE PREFERRED EMBODIMENTS

The embodiment of this invention will be explained in the followings, based on the Figures.

In the embodiment below, a laser printer as an apparatus attaching a unit will be explained. An apparatus attaching a unit of this invention may be an image forming apparatus other than a laser printer. For example, the apparatus attaching a unit of this invention may be a MFP having a scanner function, a facsimile function, a copying function, a function as a printer, a data transmitting function, and a server function, a facsimile device, or the like. Further, the apparatus attaching a unit of this invention can detachably install a unit having a unit side circuit including a fuse. The apparatus may be an apparatus other than an image forming apparatus.

[The First Embodiment]

Figure 1:
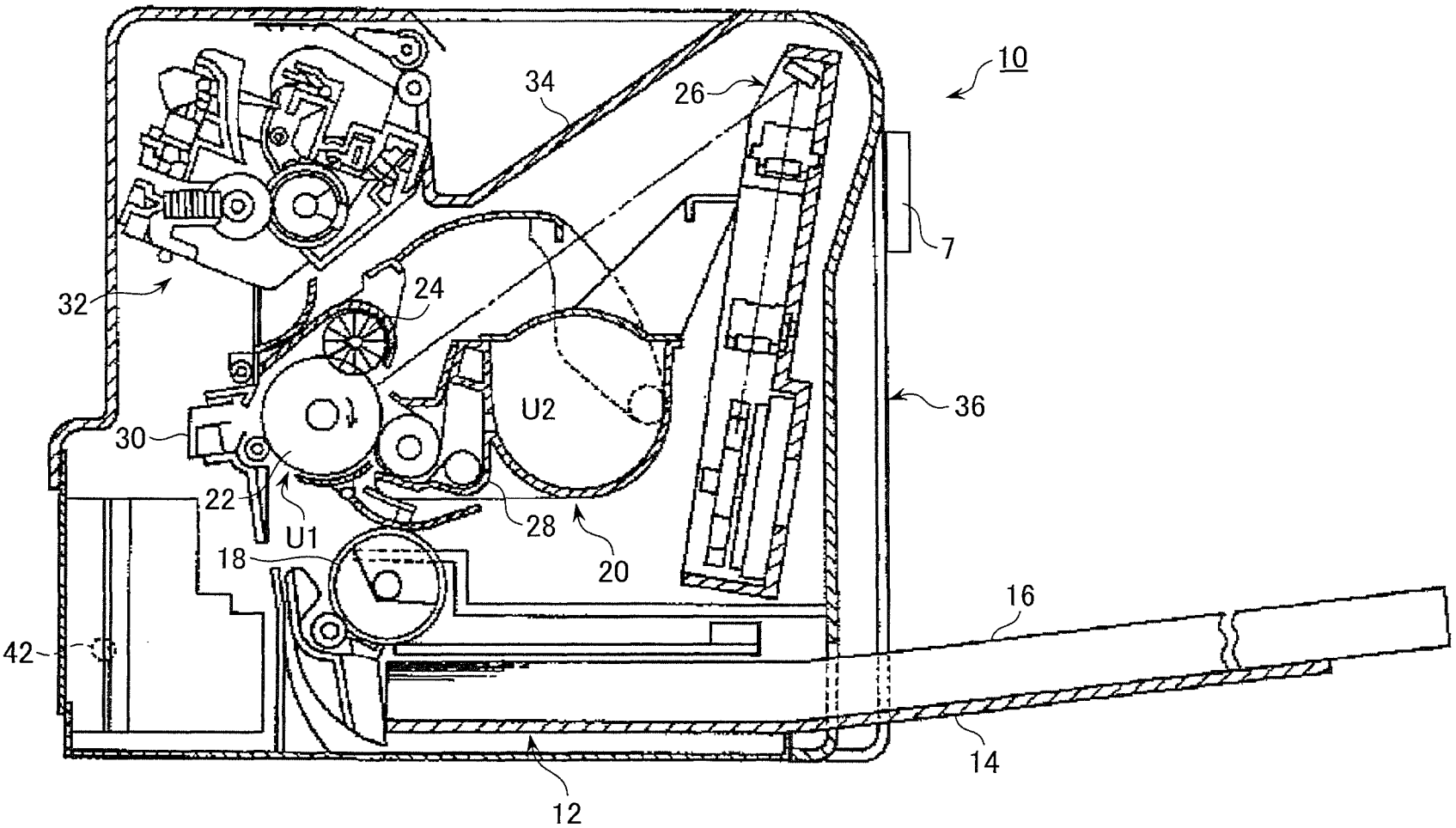
FIG. 1 shows a cross sectional view of the structure of an electrophotography laser printer 10 of the first embodiment of this invention.

Referring to FIG. 1, printer 10 of this embodiment has copy paper providing unit 12. Paper feeding cartridge 14 is detachably loaded on copy paper providing unit 12. Copy paper providing unit 12 contains paper feeding roller 18. Paper feeding roller 18 keeps in contact with the top sheet of a plurality of sheets 16 of paper stacked in paper feeding cartridge 14. By the rotation of paper feeding roller 18, each of sheets 16 is transferred to image forming unit 20 one by one.

Image forming unit 20 generates images on sheets 16 based on electrophotographic method. Image forming unit 20 has cylindrical photo conductor 22 which is an electrostatic latent image supporting body, electrostatic charging brush 24 which electrostatically charges the outer circumference surface of photo conductor 22, laser exposure device 26 which generates electrostatic latent images by exposing the outer circumference surface of electrostatic charged photo conductor 22 using laser beams, developing device 28 which makes electrostatic latent images visible using developer (toner), and transfer device 30 which transfers the developed visible images from photo conductor 22 to sheets 16.

Printer 10 is equipped with fixing device 32 and copy receiving tray 34. Fixing device 32 fixes permanently developed images which are transferred to sheets 16 by image forming unit 20, on sheets 16. Copy receiving tray 34 is located at the position where sheets 16 are ejected, wherein developed images are fixed on sheets 16 by fixing device 32.

In printer 10, photo conductor 22 and electrostatic charging brush 24 are configured in a single unit (a photo conductor unit) U1. Developing device 28 is configured as another unit (a developing device unit) U2. Each of consumable units U1 and U2 (examples of units) is removable and replaceable with respect to printer 10 independently.

Figure 2:
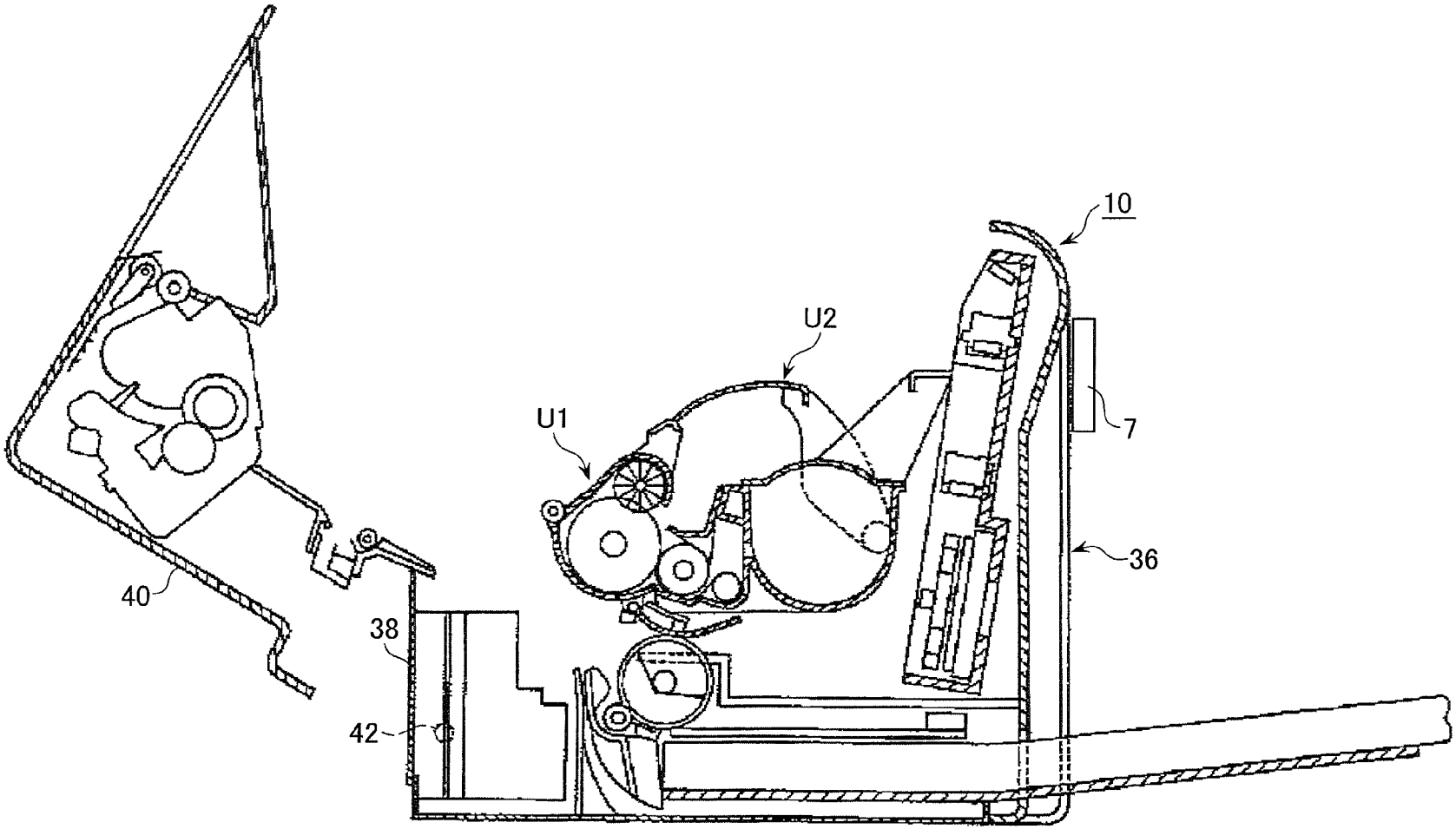
FIG. 2 shows a cross sectional view of printer 10 in FIG. 1, to explain the state when movable frame 40 is opened.

FIG. 2 shows a cross sectional view of printer 10 in FIG. 1, to explain the state when movable frame 40 is opened.

Referring to FIGS. 1 and 2, printer 10 has frame 36. Frame 36 includes fixed frame 38 which covers the lower part of printer 10, and movable frame 40 which covers the upper part of printer 10. Movable frame 40 is supported by fixed frame 38 via hinge 42. Movable frame 40 can travel between the closing location (as shown in FIG. 1) where the upper part of fixed frame 38 is closed and the opening location (as shown in FIG. 2) where the upper part of fixed frame 38 is opened. Each of display panel 7, copy paper providing unit 12, and laser exposure device 26 is fixed on fixed frame 38. Transfer device 30 and fixing device 32 are fixed on movable frame 40. Copy receiving tray 34 is integrally formed together with movable frame 40.

Consumable units U1 and U2 are detachably loaded (installed) on the opened upper part of fixed frame 38. Consumable units U1 and U2 have a shorter life span than the life span of the main body of printer 10 (the part of printer 10 other than consumable units U1 and U2). Preferably, consumable units U1 and U2 are installed in the inner part of laser printer 10, where the outside light does not reach, to prevent deterioration caused by the outside light. Hence, movable frame 40 is closed under normal conditions. Movable frame 40 is opened in case that each of consumable units U1 and U2 is replaced.

Figure 3:
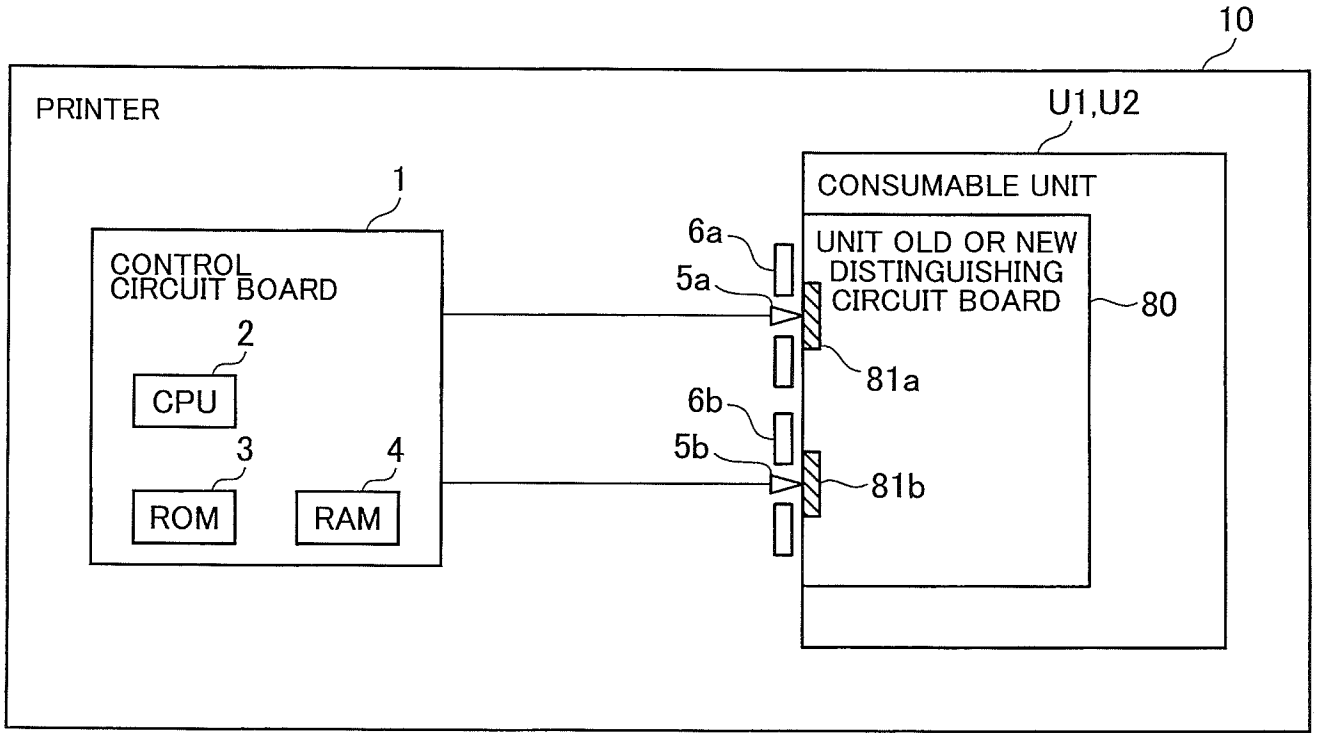
FIG. 3 schematically shows the electric connection between control circuit board 1 and distinguishing circuit board 80 in consumable unit U1 or U2.

FIG. 3 schematically shows the electric connection between control circuit board 1 and distinguishing circuit board 80 in consumable units U1 or U2.

Referring to FIG. 3, printer 10 is further equipped with control circuit board 1, contact points 5*a* and 5*b* (examples of the first and second terminals), and sheet metal plates 6*a* and 6*b* (examples of electrical conductors). Control circuit board 1 controls the behavior of image forming of printer 10. Control circuit board 1 is equipped with electric circuits includes CPU (Central Processing Unit) 2 which controls the behavior of all the parts of printer 10, ROM (Read Only Memory) 3 which stores control programs to be executed by CPU 2, and RAM (Random Access Memory) 4 which configures a working area of CPU 2.

Contact points 5*a* and 5*b* are electrically connected with control circuit board 1 via a harness. Contact points 5*a* and 5*b* are exposed outside in case that movable frame 40 is opened. Then, static electricity noise may be applied to contact points 5*a* and 5*b*. There may be static electricity at contact points 5*a* and 5*b* by extrinsic noise. Sheet metal plates 6*a* and 6*b* are maintained at ground potential, for example. Then, sheet metal plates 6*a* and 6*b* prevent control circuit board 1 from breakdown caused by static electricity noise. Sheet metal plate 6*a* is insulated from contact point 5*a* under the normal condition. Sheet metal plate 6*a* is placed around contact point 5*a*. Sheet metal plate 6*b* is insulated from contact point 5*b* under the normal condition. Sheet metal plate 6*a* is placed around contact point 5*b*.

Each of sheet metal plates 6*a* and 6*b* is located closer to each of contact points 5*a* and 5*b*. Hence, each of sheet metal plates 6*a* and 6*b* may have contact with each of contact points 5*a* and 5*b*.

Each of consumable units U1 and U2 is equipped with a unit old or new distinguishing circuit board 80 (an example of a unit side circuit, hereinafter referred to as distinguishing circuit board 80) which indicates the new or the old of consumable unit U1 or U2. Distinguishing circuit board 80 includes contact surfaces 81*a* and 81*b*. Contact surfaces 81*a* and 81*b* are exposed electrical conductive parts of distinguishing circuit board 80.

When each of consumable units U1 and U2 is loaded on printer 10 (the main body of printer 10), each of contact points 5*a* and 5*b* makes contact with each of contact surfaces 81*a* and 81*b*. Hence, control circuit board 1 and distinguishing circuit board 80 are electrically connected via these two portions. When each of consumable units U1 and U2 is detached from printer 10, each of contact points 5*a* and 5*b* does not make contact with each of contact surfaces 81*a* and 81*b*. Hence, control circuit board 1 and distinguishing circuit board 80 are electrically insulated.

Figure 4:
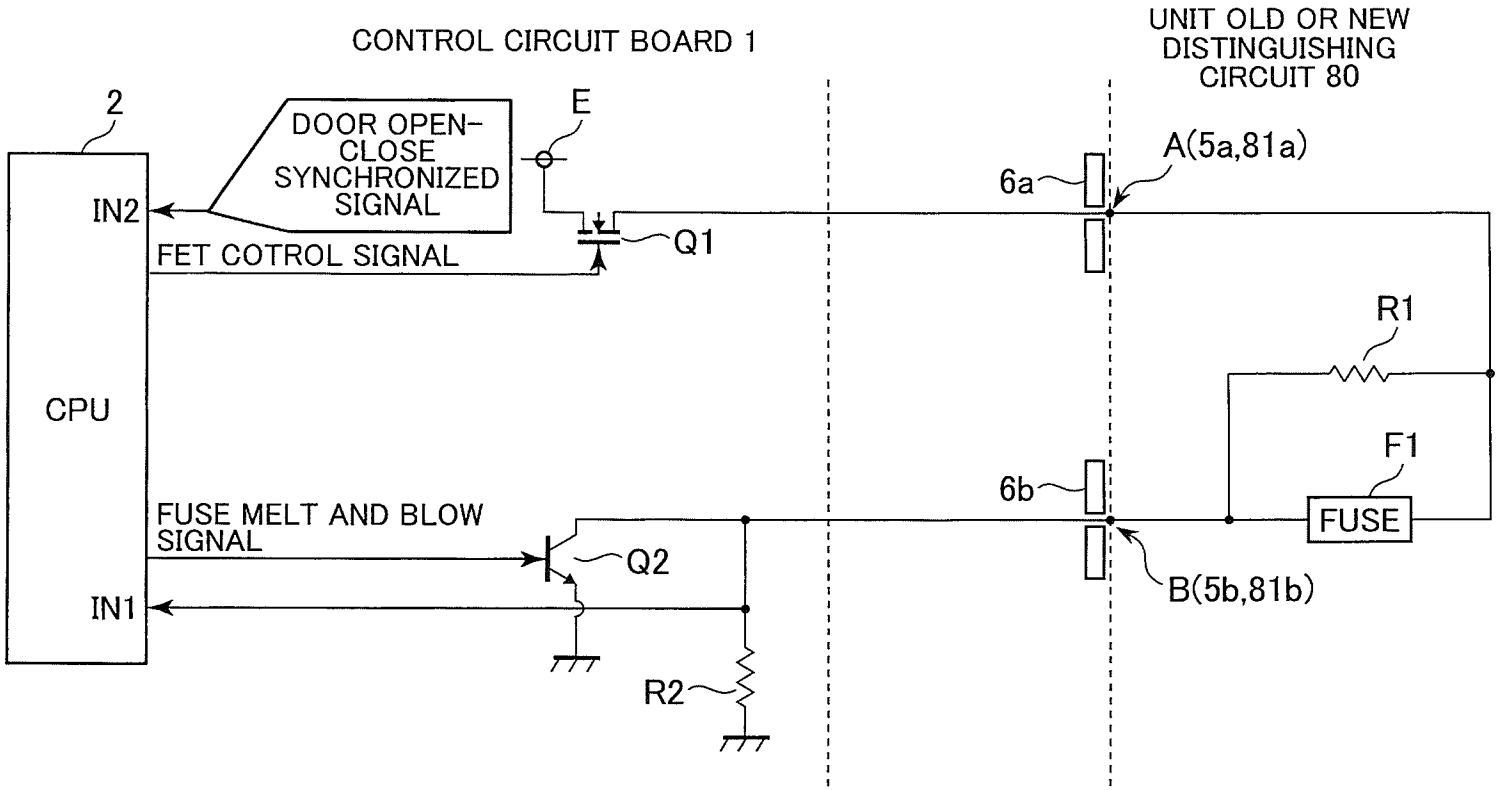
FIG. 4 schematically shows a circuit structure of printer 10, according to the first embodiment of this invention.

FIG. 4 schematically shows a circuit structure of printer 10, according to the first embodiment of this invention. Electrical potential will be described as electrical voltage, wherein the ground potential (GND) is 0V, in the following description. Distinguishing circuit board 80 which is loaded on consumable unit U1 will be described.

Referring to FIG. 4, connection part A is a connection portion between contact point 5*a* and contact surface 81*a*. Connection part A works as an electrical power supply unit. Connection part B is a connection portion between contact point 5*b* and contact surface 81*b*. Connection part B works as an electrical voltage detection unit.

Distinguishing circuit board 80 further includes fuse F1 (a fuse for distinguishing an old unit and a new unit) and resistor R1 (a resistor for distinguishing an intended delivery destination, an example of a first resistor). One end of fuse F1 is electrically connected with contact surface 81*a*. The other end of fuse F1 is electrically connected with contact surface 81*b*. Fuse F1 should melt and blow when the beginning of use of consumable unit U1. Herewith, fuse F1 indicates that consumable unit U1 is new or old. Fuse F1 melts and blows in case that electrical current around 200 mA flows, for example. Resistor R1 is parallely connected with fuse F1. The ohmic value of resistor R1 indicates information of an intended delivery destination of consumable unit U1 (information indicates which area (Asia, Europe, United States, or the like) the fabricated consumable unit is intended to be provided in). The information represented by the ohmic value of resistor R1 may be the information of the consumable unit. The information may be the information of a grade of the consumable unit, the information of the date of production of the consumable unit, or the like, as substitute for the information of the intended delivery destination.

Control circuit board 1 includes electric power supply E, transistors Q1 and Q2, and resistor R2 (an example of a second resistor). Electric power supply E is electrically connected with contact point 5*a* via transistor Q1.

Transistor Q1 is a N channel type MOSFET (Metal-Oxide-Semiconductor Field-effect Transistor), for example. The gate of transistor Q1 is electrically connected with CPU 2.

The source of transistor Q1 is electrically connected with contact point 5*a*. The drain of transistor Q1 is electrically connected with electric power supply E.

Transistor Q2 (an example of a switching device) is a NPN type bipolar transistor, for example. The base of transistor Q2 is electrically connected with CPU 2. The collector of transistor Q2 is electrically connected with contact point 5*b*. The emitter of transistor Q2 is grounded.

Resistor R2 is connected with transistor Q2 parallely. One end of resistor R2 is electrically connected with contact point 5*b*. The other end of resistor R2 is grounded.

CPU 2 includes inputting portions IN1 and IN2. Inputting portion IN1 receives signals in accordance with electrical voltage or electrical current of contact point 5*b*. Inputting portion IN2 receives a door opening-closing synchronized signal in accordance with the open-close state of movable frame 40. CPU 2 transmits a FET control signal to the gate of transistor Q1 under certain circumstances. In such a case, transistor Q1 is enabled. The FET control signal is an analog signal. Electrical voltage or electrical current being input into contact point 5*a* is controlled in accordance with the amount of electrical voltage of the FET control signal. In case only that fuse F1 will melt and blow, CPU 2 transmits a fuse melt and blow signal to the base of transistor Q2. Then, transistor Q2 is enabled. Under normal conditions, transistor Q2 is in the off state, and electrical current flows into transistor Q2 is blocked.

Next, the behavior of the printer of this embodiment will be explained. In the following description, fuse F1 does not melt and blow, if not otherwise specified.

When the door opening-closing synchronized signal input into inputting portion IN2 changes from the state of opening of movable frame 40 to the state of closing, CPU 2 detects the closing of movable frame 40. Then, CPU 2 applies current between contact point 5*a* and contact point 5*b* via distinguishing circuit board 80. Even if connection part B is at the ground potential, CPU 2 controls current input of terminal 5*a* wherein the source of the current is electric power supply E, to keep the input of terminal 5*a* low level. Hence, electrical current I1 which can not make fuse F1 melt and blow flows in fuse F1. This condition may be referred to as the first control condition. Under the first control condition, electrical voltage around 0.3V, for example is applied to contact point 5*a*. Electrical current less than 200 mA is applied to fuse F1 for example.

Under the first control condition, CPU 2 may gradually increase electrical current applied to fuse F1. The fixed amount of electrical current may be applied to fuse F1. Under the first control condition, in case that the electrical current applied to fuse F1 increases gradually, the upper limit of the electrical current applied to fuse F1 shall be electrical current I1.

In case that CPU 2 is controlling the apparatus under the first control condition, CPU 2 determines the presence of abnormal circumstances of the connection between control circuit board 1 and distinguishing circuit board 80, based on the signal input into inputting portion IN1. CPU 2 determines the presence of abnormal circumstances of the connection between control circuit board 1 and distinguishing circuit board 80 by reference to the table of FIG. 5.

FIG. 5 shows a table indicates the relationship between the connection states of control circuit board 1 and distinguishing circuit board 80 and the signal input to inputting portion IN1, when controlling under the first controlling condition, according to the first embodiment of this invention.

Referring to FIGS. 4 and 5, this table is stored in ROM 3, for example. When control circuit board 1 and distinguishing circuit board 80 are connected correctly (consumable unit U1 is loaded on printer 10 correctly) and both connection parts A and B are normal (in case that there is not an abnormality), there is not an abnormality at the connection between control circuit board 1 and distinguishing circuit board 80. In this case, electrical current flows in distinguishing circuit board 80 and resistor R2. The electrical voltage applied to contact point 5*a* by electric power supply E is divided by combined resistance Ra which consists of resistor R1 and fuse F1 (or only resistor R1 in case that the fuse melted and blew), and resistor R2. In consequence, inputting portion IN1 receives a signal (the magnitude of which is not zero) in accordance with electrical voltage or electrical current at contact point 5*b*.

In case that control circuit board 1 and distinguishing circuit board 80 are not correctly connected, or in case that consumable unit U1 is not loaded correctly on printer 10 (or the unit is not loaded), electrical voltage of both contact points 5*a* and 5*b* is zero (electrical potential of both contact points 5*a* and 5*b* is at ground potential). In consequence, electrical current does not flow in distinguishing circuit board 80 and resistor R2. In this case, inputting portion IN1 does not receive signals.

When there is an abnormal circumstance at connection part A (contact point 5*a* and sheet metal plate 6*a* shorted out), electrical voltage of contact points 5*a* and 5*b* is zero (electrical potential of contact points 5*a* and 5*b* is at the ground potential). In consequence, electrical current does not flow in distinguishing circuit board 80 and resistor R2. In this case, inputting portion IN1 does not receive signals.

In case that there is an abnormal circumstance at connection part B (contact point 5*b* and sheet metal plate 6*b* shorted out), electrical voltage of contact point 5*b* is zero (electrical potential of contact point 5*b* is at the ground potential). In consequence, electrical voltage or electrical current which equals to electrical voltage or electrical current applied to connection part A by electric power supply E is applied to fuse F1. However, the output of electric power supply E is being controlled so that the output is at the low power state. Then, fuse F1 does not melt and blow. In case that there is an abnormal circumstance at connection part B, electrical current does not flow in resistor R2 and inputting portion IN1 does not receive signals.

As presented above, in case that there is an abnormal circumstance at the connection between control circuit board 1 and distinguishing circuit board 80 (namely, in case that the unit is not loaded, in case that there is an abnormal circumstance at connection part A, or in case that there is an abnormal circumstance at connection part B), CPU 2 displays messages on display panel 7 to inform the abnormal circumstances of the connection or the state of the unit unloaded, for example.

In case that there is not an abnormal circumstance at the connection between control circuit board 1 and distinguishing circuit board 80, CPU 2 changes the output of electric power supply E to contact point 5*a*. In case that connection part B is at the ground potential, CPU 2 controls the output of electric power supply E to terminal 5*a* so that the output of electric power supply E to terminal 5*a* is at the high power state, and electrical current 12 which can make fuse F1 melt and blow flows in fuse F1. This condition may be referred to as the second control condition. Under the second control condition, electrical voltage around 3.3V, for example is applied to contact point 5*a*. Herewith, in case that connection part B is at ground potential, electrical current more than or equal to 200 mA is applied to fuse F1, for example. Under the second control condition, in case that connection part B is at ground potential, the FET control signal is preferably controlled so that the fixed amount of electrical current flows in fuse F1.

Under the second control condition, keeping transistor Q2 off, CPU2 determines whether fuse F1 of distinguishing circuit board 80 melted or not, based on the signal input to inputting portion IN1, so that CPU 2 determines whether consumable unit U1 is new or old. The signal input to inputting portion IN1 varies depend on whether fuse F1 melted or not, as explained in the followings.

In case that consumable unit U1 is old, fuse F1 melted and blew. In this case, electrical voltage applied to contact point 5*a* by electric power supply E is divided by resistor R1 and resistor R2. In consequence, the signal which corresponds to the divided voltage based on the ohmic values of resistors R1 and R2 is input to inputting portion IN1.

In case that consumable unit U1 is new, fuse F1 does not melt and blow. In this case, electrical voltage applied to contact point 5*a* by electric power supply E is divided by combined resistance Ra which consists of resistor R1 and fuse F1, and resistor R2. In consequence, the signal which corresponds to the divided voltage based on the ohmic values of combined resistance Ra and resistor R2 is input to inputting portion IN1.

Under the control of the first control condition, not the second control condition, whether consumable unit U1 is old or new can be determined based on the signal input to inputting portion IN1. However, under the first control condition, the signal input to inputting portion IN1 is faint. To determine whether consumable unit U1 is old or new, the signal input to inputting portion IN1 should be somewhat different when consumable unit U1 is new from when consumable unit U1 is old. Hence, whether consumable unit U1 is old or new is preferably determined when controlling under the second control condition.

For example, in case that the ohmic value of fuse F1 is set at around 0.1 ohm to 10 ohm, and the ohmic value of resistor R2 is set at around 100 ohm to 100 kilo-ohm, the electrical voltage or electrical current input to inputting portion IN1 greatly changes according to whether fuse F1 melted or not. Hence, the electrical voltage which can determine whether fuse F1 melted or not is applied to contact point 5*a*. Then, whether fuse F1 melted or not is easily determined by confirming the electrical voltage value input to inputting portion IN1.

In case that CPU 2 determines consumable unit U1 is new, CPU 2 transmits a fuse melt and blow signal to the base of transistor Q2. CPU 2 keeps transistor Q2 enable and controls the output of electric power supply E under the second control condition. Herewith, the electrical current flows in transistor Q2 and connection part B is at the ground potential. The large electrical current flows in Fuse F1, and fuse F1 melts and blows. After fuse F1 melted and blew, CPU 2 stops transmitting the fuse melt and blow signal under the second control condition to turn transistor Q2 off. Herewith, a signal (the electrical voltage or electrical current which corresponds to the ohmic value of resistor R1) which corresponds to the divided voltage depended on the ohmic values of resistors R1 and R2 is input to inputting portion IN1. CPU 2 determines the intended delivery destination of consumable unit U, based on the signal.

In case that CPU 2 determines consumable unit U1 is new, printer 10 may execute an image stabilization process or the like, to execute the image forming under the condition matches characteristic features of the exchanged consumable unit. In case that the exchanged consumable unit is a toner bottle, printer 10 may shake toner in the toner bottle.

Figure 6:
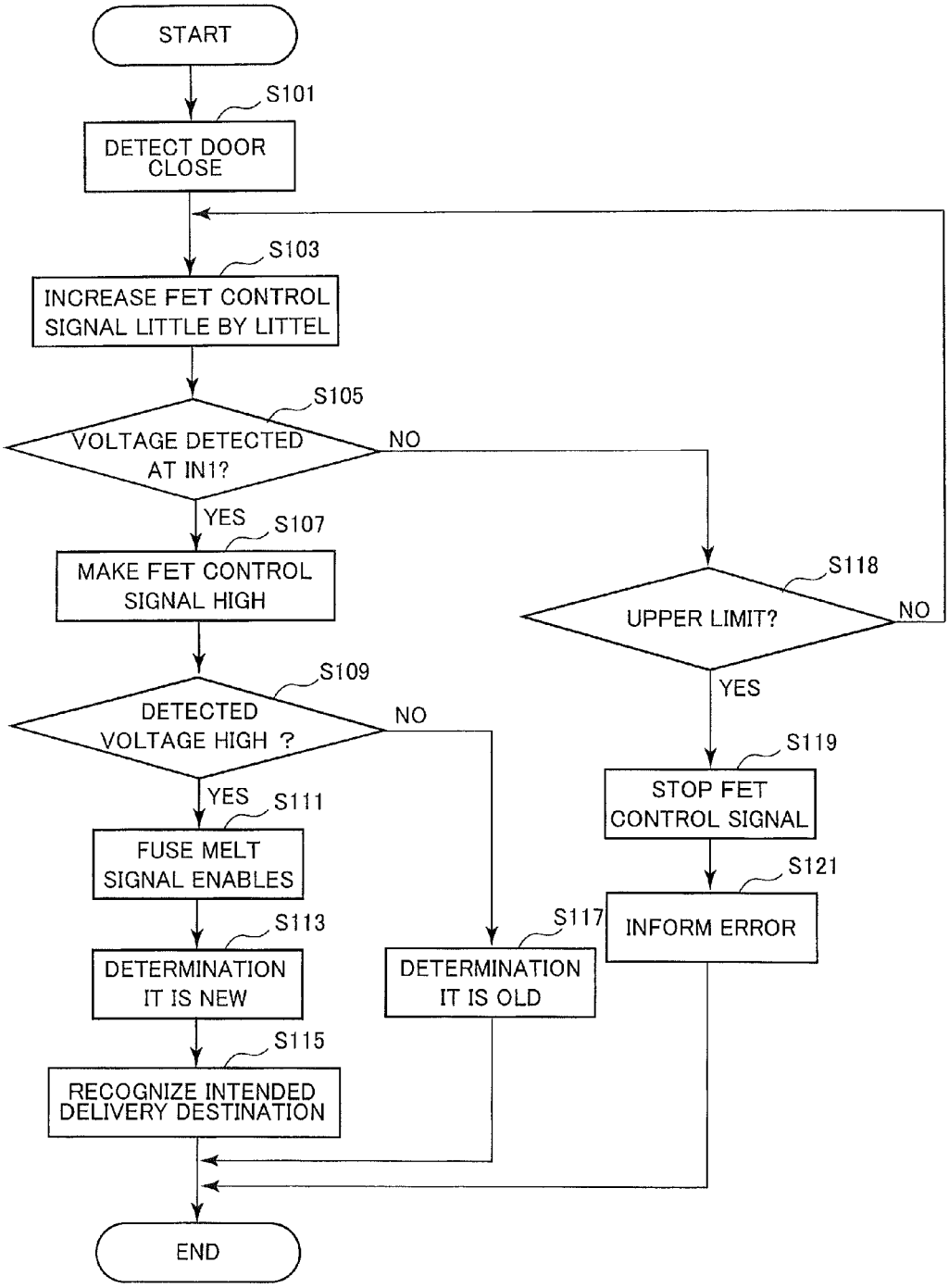
FIG. 6 shows a flowchart of a process executed by CPU 2 in control circuit board 1, in case that movable frame 40 is closed, according to the first embodiment of this invention.

FIG. 6 shows a flowchart of a process executed by CPU 2 in control circuit board 1, in case that movable frame 40 is closed, according to the first embodiment of this invention.

Referring to FIG. 6, when CPU 2 detects closing of movable frame 40 (a door) (S101), CPU 2 increases the FET control signal little by little from the lower limit, so that CPU 2 controls the output of electric power supply E under the first control condition (S103). Herewith, the electrical current which flows in fuse F1 increases little by little. Next, CPU 2 determines whether the electrical voltage is detected at inputting portion IN1 or not (S105).

In case that CPU 2 determined that the electrical voltage was detected at inputting portion IN1 at step S105 (YES at S105), CPU 2 recognizes that there is not abnormal circumstance at the connection between control circuit board 1 and distinguishing circuit board 80, and makes the FET control signal high output. Namely, the output of electric power supply E is controlled under the second control condition (S107). Next, CPU 2 determines whether the electrical voltage detected at inputting portion IN1 is more than or equal to the prescribed value or not (S109).

In case that CPU 2 determines that the electrical voltage detected at inputting portion IN1 is more than or equal to the prescribed value at step S109 (YES at S109), CPU 2 makes the fuse melt and blow signal enable, and makes fuse F1 melt and blow (S111). CPU 2 recognizes consumable unit U1 is new (S113). CPU 2 recognizes the intended delivery destination of consumable unit U1 (S115), and terminates the process.

In case that CPU 2 determines that the electrical voltage was not detected at inputting portion IN1 at step S105 (NO at S105), CPU 2 determines whether the FET control signal reaches the upper limit or not (S118). The upper limit of the FET control signal is a value when the electrical current flows in fuse F1 reaches the upper limit (electrical current I1).

In case that CPU 2 determines that the FET control signal reaches the upper limit at step S118 (YES at S118), CPU 2 recognizes that there is an abnormal circumstance at the connection between control circuit board 1 and distinguishing circuit board 80, and stops the FET control signal (S119). Next, CPU 2 informs the errors of the abnormal circumstance in the connection or of the unit unloaded (S121), and terminates the process.

In case that CPU 2 determines that the FET control signal does not reach the upper limit at step S118 (NO at S118), CPU 2 proceeds to the process of step S103, and further increases the FET control signal.

In case that CPU 2 determines that the electrical voltage detected at inputting portion IN1 is less than the prescribed value at step S109 (NO at S109), CPU 2 recognizes that the fuse melted and blew and consumable unit U1 is old (S117). Then CPU 2 terminates the process.

As for the circuit structure of FIG. 4, transistor Q2 may be omitted. In the case, CPU 2 may transmit the fuse melt and blow signal to the gate of transistor Q1. According to the circuit structure, CPU 2 controls the FET control signal, so that the electrical voltage or electrical current applied to connection part A becomes larger than the second control condition. Then, fuse F1 melts and blows.

Printer 10 of this embodiment controls the electrical voltage or electrical current of electric power supply E, so that the electrical current which does not make fuse F1 melt and blow flows in fuse F1, before determining whether consumable unit U1 or U2 is old or new. Then, CPU 2 determines whether there is an abnormal circumstance at the connection between control circuit board 1 and distinguishing circuit board 80.

Herewith, fuse F1 does not melt and blow inadvertently by abnormal circumstances at the connection between control circuit board 1 and distinguishing circuit board 80.

In addition, when increasing the electrical current flows in fuse F1 little by little under the first control condition, the electrical voltage or electrical current applied to contact point 5*a* during detecting abnormal circumstances of the connection can be turned down to the extent possible. Hence, it can prevent fuse F1 from mistaken melting and blowing.

Assume a structure in which a door opening-closing synchronized signal is directly input to the gate of transistor Q1, not to inputting portion IN2. According to the structure, CPU 2 can not execute controlling in accordance with the door opening-closing synchronized signal. Hence, the fuse may inadvertently melt and blow by abnormal circumstances at the connection between control circuit board 1 and distinguishing circuit board 80. The detailed situation will be explained in the followings.

Figure 7:
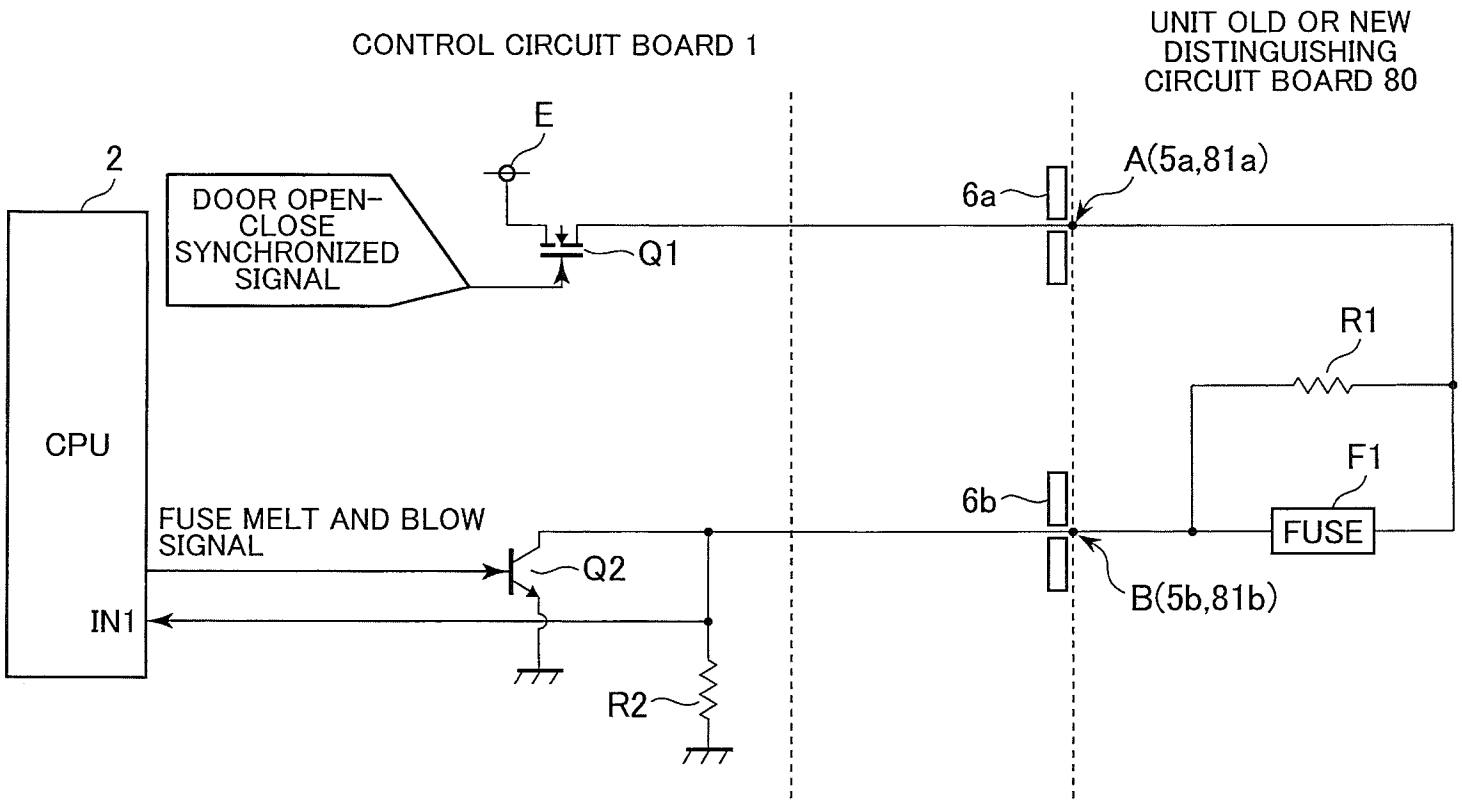
FIG. 7 schematically shows a circuit structure in printer 10, in case that a door opening-closing synchronized signal is directly input to the gate of transistor Q1.

FIG. 7 schematically shows a circuit structure in printer 10, in case that a door opening-closing synchronized signal is directly input to the gate of transistor Q1. The circuit structure of FIG. 7 is mostly the same as the circuit structure of FIG. 4 in the first embodiment, except that the door opening-closing synchronized signal is input to the gate of transistor Q1. The same numerals are given for the same components, and the explanations are not repeated.

Referring to FIG. 7, a door opening-closing synchronized signal which is a digital output is input to the gate of transistor Q1. Herewith, when movable frame 40 opens, transistor Q1 is turned off. When movable frame 40 closes, transistor Q1 is turned on. The output of electric power supply E is not controlled by CPU 2. Then, when transistor Q1 is turned on, the large electrical voltage or electrical current is applied to contact point 5*a*. CPU 2 determines whether fuse F1 in distinguishing circuit board 80 melted, based on a signal input to inputting portion IN1. CPU 2 determines whether consumable unit U1 is old or new.

In case that the unit is not loaded or in case that there are abnormal circumstances at connection part A, inputting portion IN1 does not receive signals. In this case, CPU 2 uniformly determines that the unit is not loaded.

On the other hand, in case that there are abnormal circumstances at connection part B, the electrical voltage of connection part B is zero (the electrical potential of connection part B is at the ground potential). The electrical voltage or electrical current same as the electrical voltage applied to terminal 5*a* is applied to fuse F1. In the case, fuse F1 melts and blows. In consequence, CPU 2 mistakenly determines that consumable unit U1 is old, although consumable unit U1 is new. According to the embodiment of this invention, CPU 2 determines the presence of an abnormal circumstance at the connection between control circuit board 1 and distinguishing circuit board 80, using the electrical current which does not make fuse F1 melt and blow, before determining whether consumable unit U1 is old or new. Hence, the erroneous determination of consumable unit U1 old or new in the above described can be avoided.

According to this embodiment, a reliable apparatus attaching a unit can be provided.

[The Second Embodiment]

Figure 8:
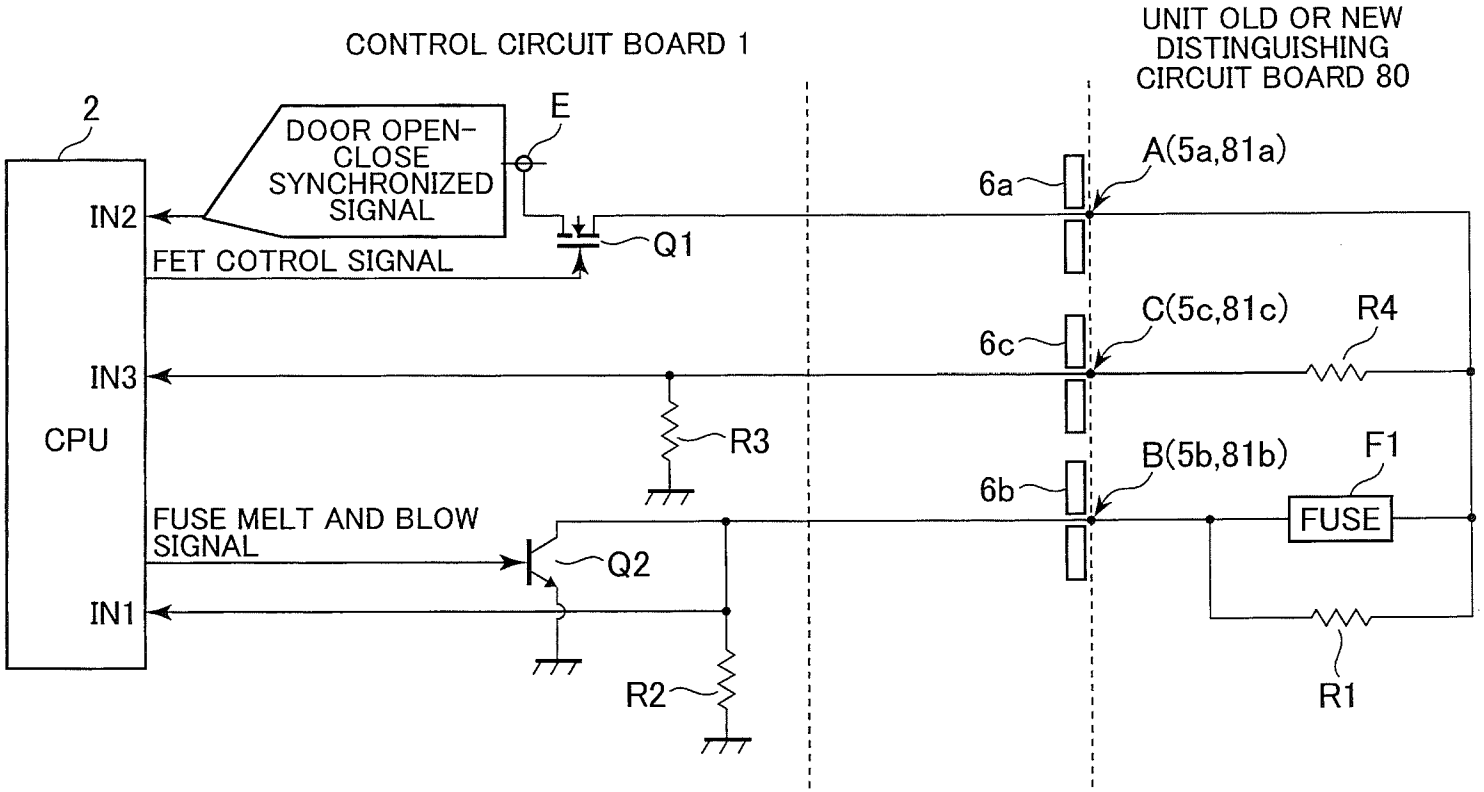
FIG. 8 schematically shows a circuit structure of printer 10, according to the second embodiment of this invention.

FIG. 8 schematically shows a circuit structure of printer 10, according to the second embodiment of this invention.

Referring to FIG. 8, distinguishing circuit board 80 of this embodiment further includes contact surface 81*c* and resistor R4 (an example of the third resistor). Contact surface 81*c* is an exposed electrically conductive part of distinguishing circuit board 80. One end of resistor R4 is electrically connected with contact surface 81*a*. The other end of resistor R4 is electrically connected with contact surface 81*c*. According to this embodiment, the ohmic value of resistor R4, not the ohmic value of resistor R1, indicates information of the intended delivery destination of the consumable unit (resistor R4 is a resistor for distinction of the intended delivery destination).

Printer 10 is further equipped with contact point 5*c* (an example of the third terminal) which is electrically connected with control circuit board 1 via a harness, and sheet metal plate 6*c* (an example of an electrical conductor). Sheet metal plate 6*c* is kept at the ground potential, for example to prevent control circuit board 1 from breaking by static electricity noise. Sheet metal plate 6*c* is insulated from contact point 5*c* under the normal condition. Sheet metal plate 6*c* is equipped around contact point 5*c*.

Control circuit board 1 further includes resistor R3 (an example of the fourth resistor). One end of resistor R3 is electrically connected with contact point 5*c*. The other end of resistor R3 is grounded. CPU 2 further includes inputting portion IN3. Inputting portion IN3 of CPU 2 receives signals according to the electrical voltage or electrical current of contact point 5*c*.

In case that consumable unit U1 is loaded on printer 10 (the main body of printer 10), contact point 5*c* makes contact with contact surface 81*c* and constitutes connection part C. Herewith, control circuit board 1 and distinguishing circuit board 80 are electrically connected by three points. Connection part A constitutes an electrical power supply portion. Connection part B constitutes an old and new unit detecting portion. Connection part C is a connection part between contact point 5*c* and contact surface 81*c* and constitutes an intended delivery destination detection portion for the product.

In case that consumable unit U1 is loaded on printer 10 (the main body of printer 10), each of contact points 5*a*, 5*b*, and 5*c* keeps contact with each of contact surfaces 81*a*, 81*b*, and 81*c*. Herewith, control circuit board 1 and distinguishing circuit board 80 are electrically connected by three points.

Next, the behavior of the printer of this embodiment will be explained.

When the door opening-closing synchronized signal input into inputting portion IN2 changes from the state of opening of movable frame 40 to the state of closing, CPU 2 controls the output of electric power supply E under the first control condition. CPU 2 determines whether there is an abnormal circumstance at the connection between control circuit board 1 and distinguishing circuit board 80, based on signals input to inputting portions IN1 and IN3. CPU 2 determines whether there is an abnormal circumstance at the connection between control circuit board 1 and distinguishing circuit board 80, referring to the table of FIG. 9.

FIG. 9 shows a table indicates the relationship between the connection states of control circuit board 1 and distinguishing circuit board 80 and the signals input to each of inputting portions IN1 and IN3, when controlling under the first controlling condition, according to the second embodiment of this invention.

Referring to FIGS. 8 and 9, this table is stored in ROM 3, for example. When consumable unit U1 is loaded on printer 10 correctly and both connection parts A and B are normal (in case that there is not an abnormality), the electrical current flows in distinguishing circuit board 80 and resistors R2 and R3. In consequence, each of inputting portions IN1 and IN3 receives signals (signals, the magnitude of which is not zero) in accordance with the electrical voltage or electrical current at each of contact points 5*b* and 5*c*.

When the unit is not loaded, the electrical voltage at contact points 5*a*, 5*b*, and 5*c* is zero (the electrical potential of contact points 5*a*, 5*b*, and 5*c* is at the ground potential). In consequence, inputting portions IN1 and IN3 do not receive signals.

In case that there is an abnormal circumstance at connection part A, the electrical voltage at contact points 5*a*, 5*b*, and 5*c* is zero (the electrical potential at contact points 5*a*, 5*b*, and 5*c* is at the ground potential). In consequence, inputting portions IN1 and IN3 do not receive signals.

In case that there is an abnormal circumstance at connection part B, the electrical voltage of contact point 5*b* is zero (the electrical potential at contact point 5*b* is at the ground potential). In consequence, the electrical current does not flow in resistor R2, and inputting portion IN1 does not receive signals. On the other hand, the electrical current flows in resistor R3, and inputting portion IN3 receives a signal (a signal, the magnitude of which is not zero) according to the electrical voltage or electrical current at contact point 5*c*.

In case that there is an abnormal circumstance at connection part C, the electrical voltage of contact point 5*c* is zero (the electrical potential at contact point 5*c* is at the ground potential). In consequence, the electrical current does not flow in resistor R3, and inputting portion IN3 does not receive signals. On the other hand, the electrical current flows in resistor R2, and inputting portion IN1 receives a signal (a signal, the magnitude of which is not zero) according to the electrical voltage or electrical current at contact point 5*b*.

In case that there is not an abnormal circumstance at the connection between control circuit board 1 and distinguishing circuit board 80, CPU 2 determines whether consumable unit U1 is old or new, in the same manner as the first embodiment.

In case that CPU 2 determines consumable unit U1 is new, CPU 2 make fuse F1 melt and blow in the same manner as the first embodiment. After that, CPU 2 recognizes the intended delivery destination of consumable unit U1, based on signals input into inputting portion IN3. This recognition of the intended delivery destination of consumable unit U1 may be executed at the same time that fuse F1 melts and blows. This recognition may be executed before fuse F1 melts and blows.

Figure 10:
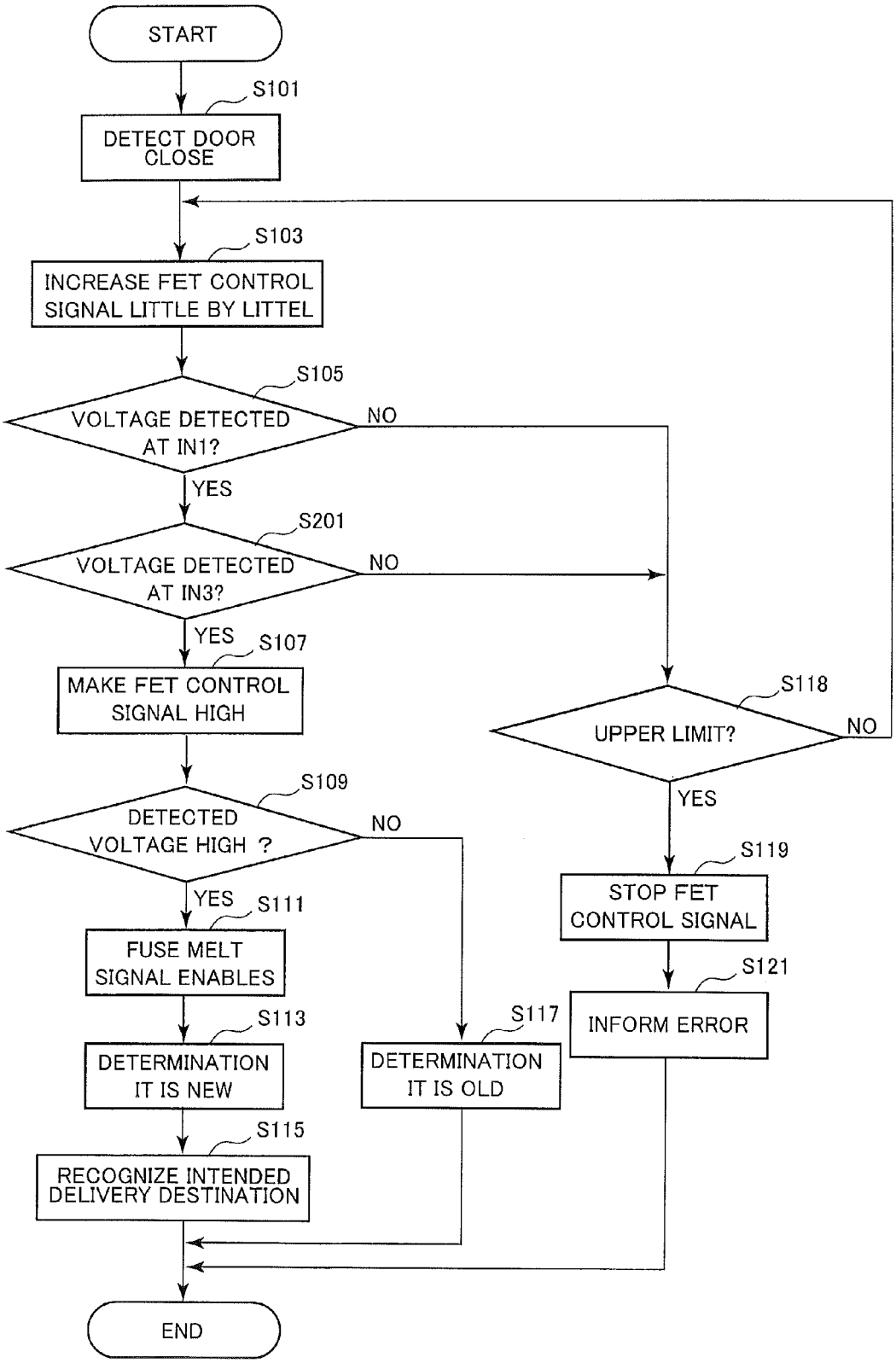
FIG. 10 shows a flowchart of a process executed by CPU 2 in control circuit board 1, in case that movable frame 40 is closed, according to the second embodiment of this invention.

FIG. 10 shows a flowchart of a process executed by CPU 2 in control circuit board 1, in case that movable frame 40 is closed, according to the second embodiment of this invention.

Referring to FIG. 10, CPU 2 firstly executes the same processes as the processes from step S101 to step S105 of the flowchart in FIG. 6. At step S105, in case that CPU 2 determines that the electrical voltage is detected at inputting portion IN1 (YES at S105), CPU 2 determines whether the electrical voltage is detected at inputting portion IN3 or not (S201).

At step S201, in case that the electrical voltage is detected at inputting portion IN3 (YES at S201), CPU 2 recognizes that there is not an abnormal circumstance at the connection between control circuit board 1 and distinguishing circuit board 80. Then CPU 2 executes the same processes as the processes from step S107 of the flowchart in FIG. 6. On the other hand, at step S201, in case that the electrical voltage is not detected at inputting portion IN3 (NO at S201), CPU 2 executes the same processes as the processes from step S118 of the flowchart in FIG. 6.

Since the structure and behavior of the printer except for the above description are the same as the first embodiment, the explanation is not repeated.

As for the circuit structure of FIG. 8, transistor Q2 may be omitted. In the case, CPU 2 may transmit the fuse melt and blow signal to the gate of transistor Q1. According to the circuit structure, CPU 2 controls the FET control signal so that the electrical voltage or electrical current applied to connection part A becomes larger than the second control condition. Then, fuse F1 melts and blows.

According to this embodiment, resistor R4 which indicates information of the intended delivery destination of consumable unit U1, and resistor R1 for making fuse F1 melt and blow can be separated in structure.

[The Third Embodiment]

Figure 11:
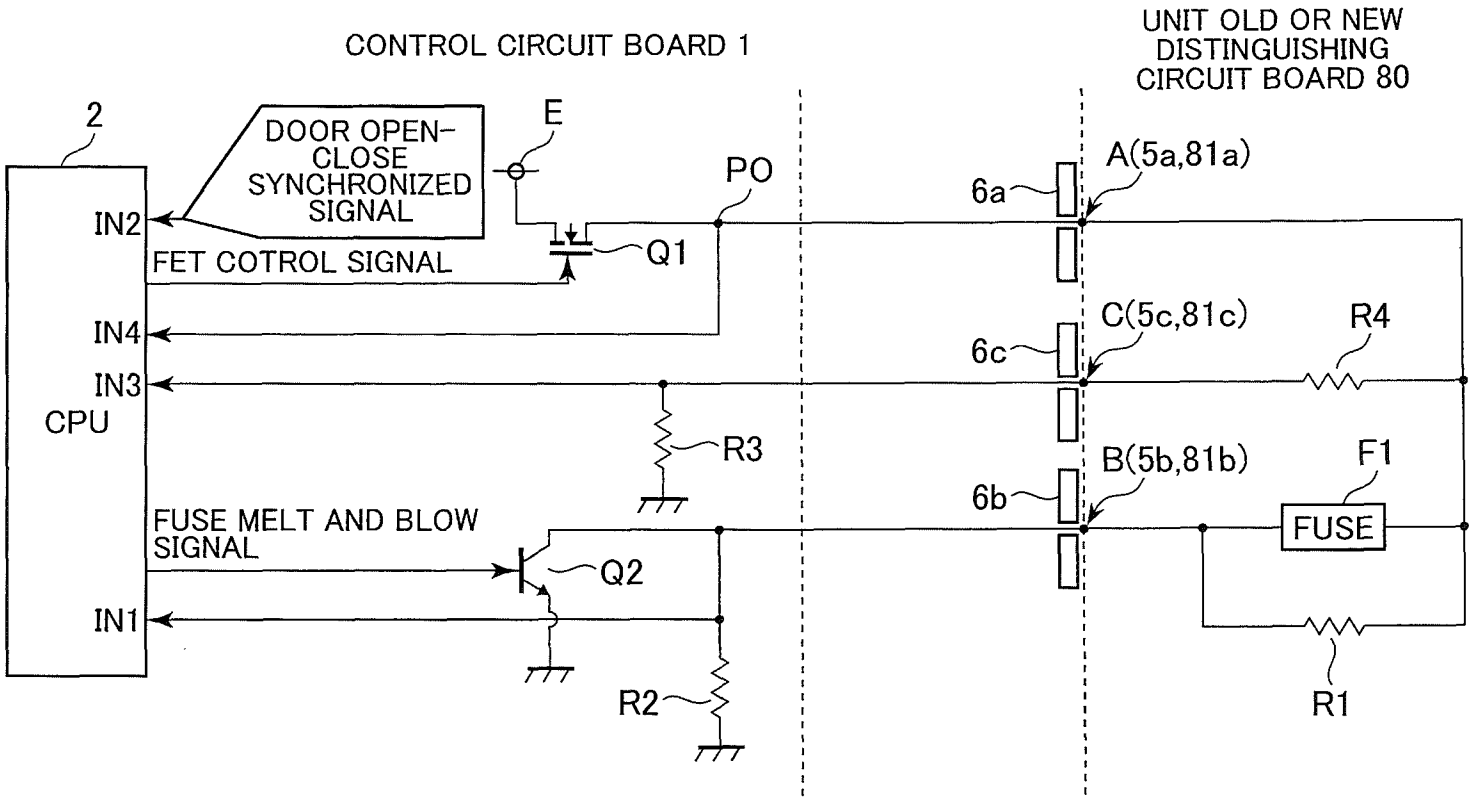
FIG. 11 schematically shows a circuit structure in printer 10, according to the third embodiment of this invention.

FIG. 11 schematically shows a circuit structure in printer 10, according to the third embodiment of this invention.

Referring to FIG. 11, according to this embodiment, CPU 2 further includes inputting portion IN4 which is a portion for detecting a CPU electric power supply. Inputting portion IN4 of CPU 2 receives signals according to the electrical voltage or electrical current at location PO which is located between the source of transistor Q1 and contact point 5*a*.

Next, the behavior of the printer of this embodiment will be explained,

When the door opening-closing synchronized signal input into inputting portion IN2 changes from the state of opening of movable frame 40 to the state of closing, CPU 2 controls the output of electric power supply E under the first control condition. CPU 2 determines whether there is an abnormal circumstance at the connection between control circuit board 1 and distinguishing circuit board 80, based on signals input to inputting portions IN1, IN3, and IN4. In case that there is an abnormal circumstance at the connection between control circuit board 1 and distinguishing circuit board 80, CPU 2 identifies the type of the abnormal circumstance, referring to the table of FIG. 12.

FIG. 12 shows a table indicates the relationship between the connection states of control circuit board 1 and distinguishing circuit board 80 and the signals input to each of inputting portions IN1, IN3 and IN4, when controlling under the first controlling condition, according to the third embodiment of this invention.

Referring to FIGS. 11 and 12, this table is stored in ROM 3, for example. When consumable unit U1 is loaded on printer 10 correctly and both connection parts A and B are normal (in case that there is not an abnormality), the electrical current flows in distinguishing circuit board 80 and resistors R2 and R3. In consequence, each of inputting portions IN1, IN3, and IN4 receives signals (signals, the magnitude of which is not zero) in accordance with the electrical voltage or electrical current at each of contact points 5*b* and 5*c* and location PO.

In case that consumable unit U1 is not loaded on printer 10 (the unit is unloaded), the electrical voltage at all of contact points 5*a*, 5*b*, and 5*c* is zero (the electrical potential at contact points 5*a*, 5*b*, and 5*c* is at the ground potential). In consequence, inputting portions IN1 and IN3 does not receive signals. On the other hand, the electrical current flows in the protection circuit (not shown in the Figure) in control circuit board 1 via the location PO. Inputting portion IN4 receives signals (signals, the magnitude of which is not zero) in accordance with the electrical voltage or electrical current at location PO.

In case that there is an abnormal circumstance at connection part A, the electrical voltage at contact points 5*a*, 5*b*, and 5*c* and location PO is zero (the electrical potential at contact points 5*a*, 5*b*, and 5*c* and location PO is at the ground potential). In consequence, inputting portions IN1, IN3 and IN4 do not receive signals.

In case that there is an abnormal circumstance at connection part B, the electrical voltage of contact point 5*b* is zero (the electrical potential at contact point 5*b* is at the ground potential). In consequence, inputting portion IN1 does not receive signals. On the other hand, the electrical current flows in resistor R3 and location PO, and each of inputting portions IN3 and IN4 receive a signal (a signal, the magnitude of which is not zero) according to the electrical voltage or electrical current at each of contact point 5*c* and location PO.

In case that there is an abnormal circumstance at connection part C, the electrical voltage of contact point 5*c* is zero (the electrical potential at contact point 5*c* is at the ground potential). In consequence, the electrical current does not flow in resistor R3, and inputting portion IN3 does not receive signals. On the other hand, the electrical current flows in resistor R2 and location PO, and each of inputting portions IN1 and IN4 receives a signal (a signal, the magnitude of which is not zero) according to the electrical voltage or electrical current at each of contact point 5*b* and location PO.

In case that there is an abnormal circumstance at the connection between control circuit board 1 and distinguishing circuit board 80 (namely, in case that the unit is not loaded, in case that there is an abnormal circumstance at connection part A, in case that there is an abnormal circumstance at connection part B, or in case that there is an abnormal circumstance at connection part C), CPU 2 displays messages on display panel 7 to inform the identified type of the abnormal circumstance (the contact point at where there is the abnormal circumstance of the connection, or the unit is unloaded), for example.

Figure 13:
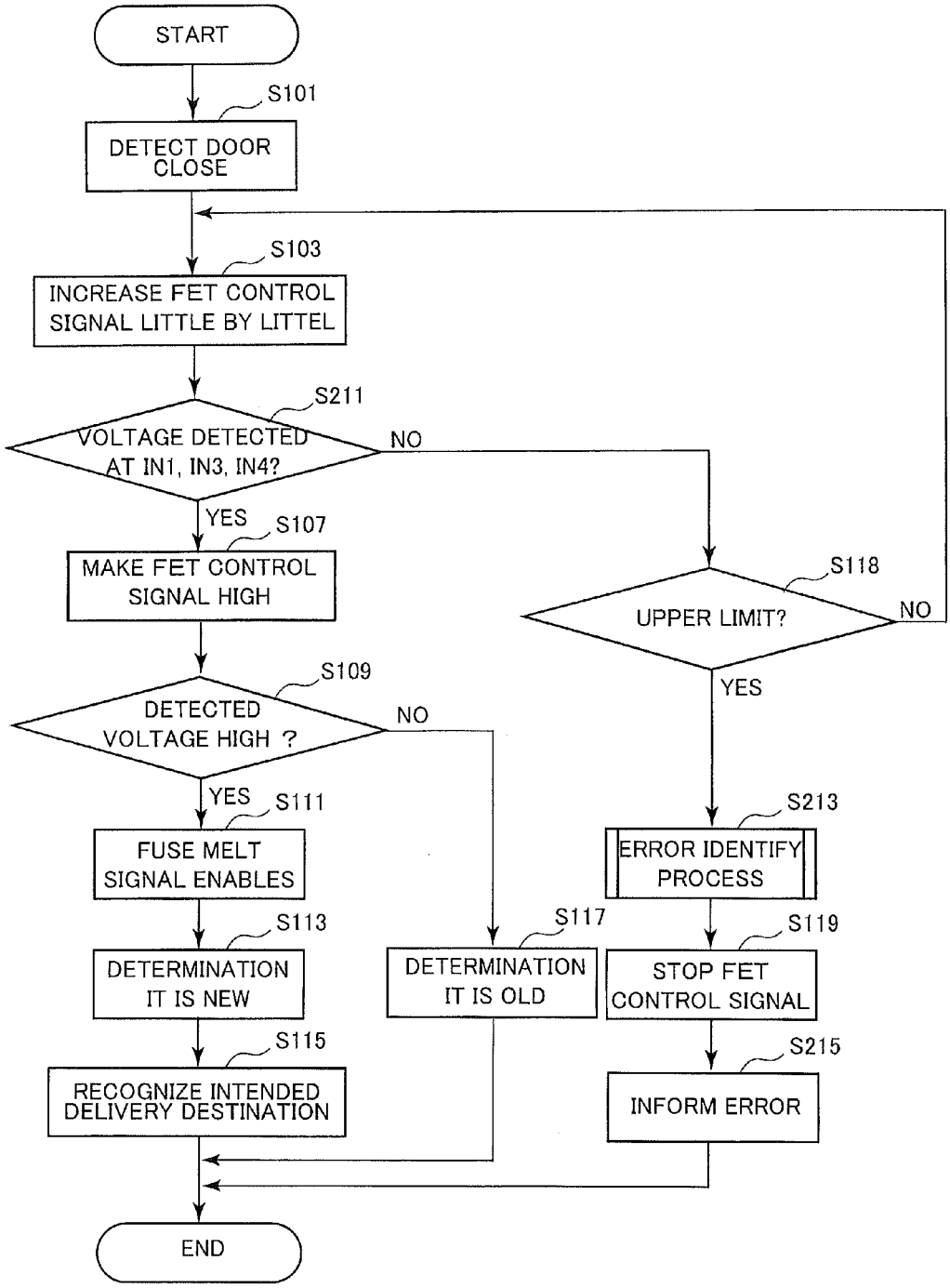
FIG. 13 shows a flowchart of a process executed by CPU 2 in control circuit board 1, in case that movable frame 40 is closed, according to the third embodiment of this invention.

FIG. 13 shows a flowchart of a process executed by CPU 2 in control circuit board 1, in case that movable frame 40 is closed, according to the third embodiment of this invention.

Referring to FIG. 13, CPU 2 firstly executes the same processes as the processes from step S101 to step S103 of the flowchart in FIG. 6. After the process of step S103, CPU2 determines whether the electrical voltage is detected at each of inputting portions IN1, IN3, and IN4 (S211).

At step S211, in case that the electrical voltage is detected at all of inputting portions IN1, IN3, and IN4 (YES at S211), CPU 2 recognizes that there is not an abnormal circumstance at the connection between control circuit board 1 and distinguishing circuit board 80. Then CPU 2 executes the same processes as the processes from step S107 of the flowchart in FIG. 6.

At step S211, in case that the electrical voltage is not detected at least one of inputting portions IN1, IN3, and IN4 (NO at S211), CPU 2 determines whether the FET control signal reaches the upper limit or not (S118).

At step S118, in case that the FET control signal reaches the upper limit (YES at S118), CPU 2 recognizes that there is an abnormal circumstance at the connection between control circuit board 1 and distinguishing circuit board 80. Then CPU 2 executes the error identify process described below, to identify the type of the abnormal circumstance (S213). Next, CPU 2 stops the FET control signal (S119), informs the type of the abnormal circumstance identified (S215), and terminates the process. On the other hand, at step S118, in case that the FET control signal does not reach the upper limit (NO at S118), CPU 2 steps in the process of step S103.

Figure 14:
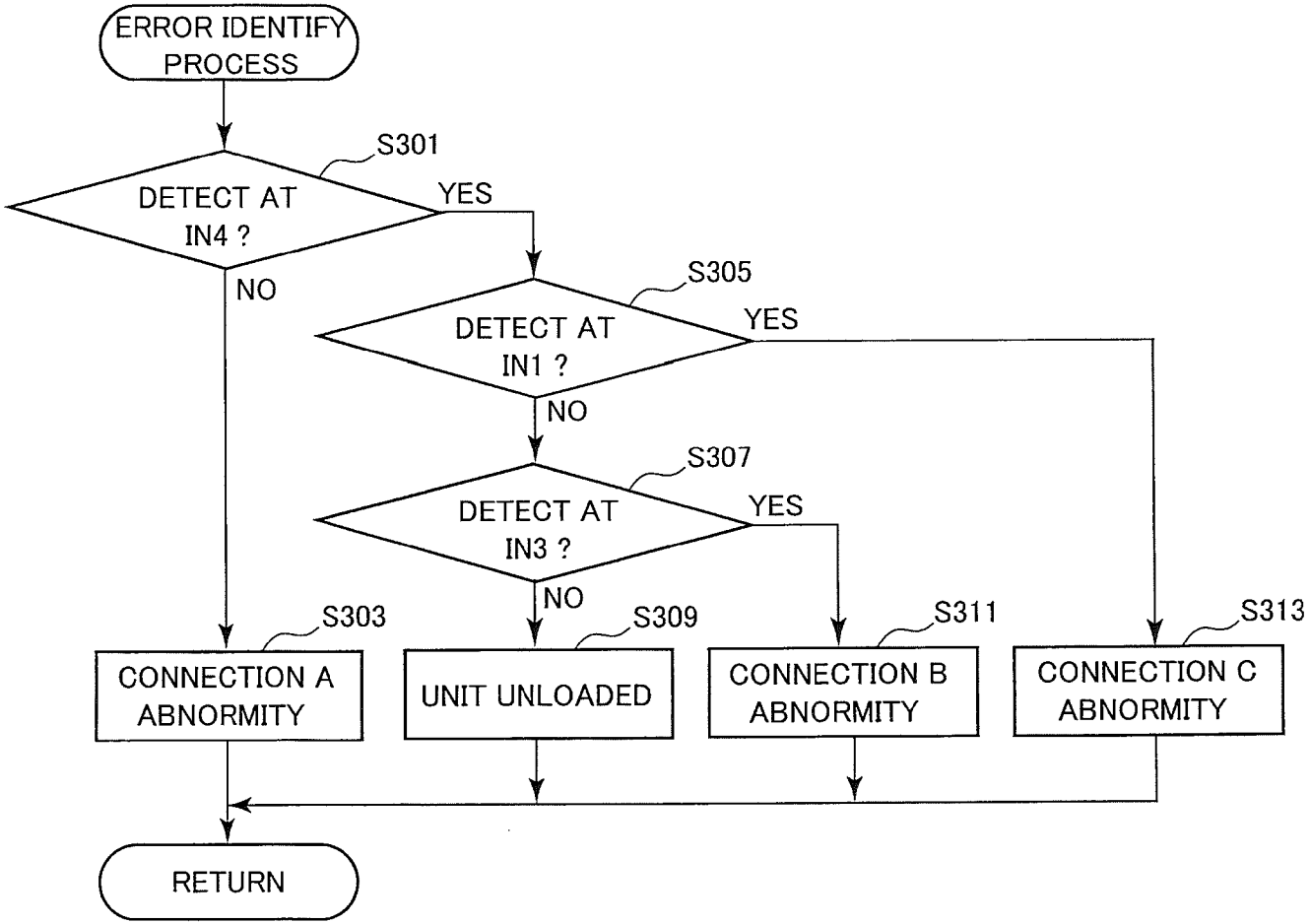
FIG. 14 shows a subroutine of an error identify process at step S213 in FIG. 13.

FIG. 14 shows a subroutine of the error identify process at step S213 in FIG. 13.

Referring to FIG. 14, in the error identify process, CPU 2 determines whether the electrical voltage is detected at inputting portion IN4 or not (S301).

At step S301, in case that CPU 2 determines that the electrical voltage is not detected at inputting portion IN4 (NO at S301), CPU 2 determines that the type of the abnormal circumstance is the abnormal circumstance of connection part A (S303), and terminates the process.

At step S301, in case that the electrical voltage is detected at inputting portion IN4 (YES at S301), CPU 2 determines whether the electrical voltage is detected at inputting portion IN1 or not (S305).

At step S305, in case that CPU 2 determines that the electrical voltage is not detected at inputting portion IN1 (NO at S305), CPU 2 determines whether the electrical voltage is detected at inputting portion IN3 (S307).

At step S305, in case that CPU 2 determines that the electrical voltage is detected at inputting portion IN1 (YES at S305), CPU 2 recognizes that the type of the abnormal circumstance is the abnormal circumstance at connection part C (S313), and terminates the process.

At step S307, in case that CPU 2 determines that the electrical voltage is not detected at inputting portion IN3 (NO at S307), CPU 2 recognizes that the type of the abnormal circumstance is the unit unloaded (S309), and terminates the process.

At step S307, in case that CPU 2 determines that the electrical voltage is detected at inputting portion IN3 (YES at S307), CPU 2 recognizes that the type of the abnormal circumstance is the abnormal circumstance of connection part B (S311), and terminates the process.

According to this embodiment, the presence of an abnormal circumstance at the connection between control circuit board 1 and distinguishing circuit board 80, and whether consumable unit U1 is loaded on printer 10 or not are determined, based on the electrical potential or electrical current at each of inputting portions IN1, IN3, and IN4, under the first control condition. Hence, the cause of the abnormal circumstance can be identified.

[Others]

The control board side circuit is not limited to the above mentioned structure. The control board side circuit needs to be equipped with a first current applying unit to apply current between the first terminal and the second terminal via the unit side circuit, so that first electrical current which can not make the fuse melt and blow flows in the fuse, and a second current applying unit to apply current between the first terminal and the second terminal via the unit side circuit, so that the second electrical current which can make the fuse melt and blow flows in the fuse.

The consumable unit needs to be equipped with a unit side circuit which includes a fuse, and to be loaded detachably on an apparatus attaching a unit. The consumable unit may be a photo conductor unit or a developing device. The consumable unit may be a toner bottle or an imaging unit to form images, for example. The electrical conductor needs to be located around the second terminal.

The above embodiments can be combined with each other. For example, the structure of the first embodiment and the structure of the third embodiment wherein signals according to the electrical voltage or electrical current at location PO between the source of transistor Q1 and contact point 5*c* are input to inputting portion IN4, can be combined. In such a case, the type of the abnormal circumstances can be identified.

The processes described in the above embodiments can be executed by software or a hardware circuit. A computer program which executes the processes in the above embodiments can be provided. The program may be provided recorded in recording media of CD-ROMs, flexible disks, hard disks, ROMs, RAM, memory cards, or the like to users. The program is executed by a computer of a CPU or the like. The program may be downloaded to a device via communication lines like the internet.

Although the preset invention has been described and illustrated in detail, it is clearly understood that the same is by way of illustration and example only and is not to be taken by way of limitation, the spirit and scope of the present invention being limited only by the terms of the appended claims.

What is claimed is:

1. An apparatus attaching a detachable unit equipped with a unit side circuit including a fuse, comprising:

first and second terminals;

an electrical conductor placed around at least the second terminal;

a hardware processor configured to:

apply a first electrical current, which is insufficient to melt and blow the fuse, between the first terminal and the second terminal via the unit side circuit so that the first electrical current flows in the fuse;

detect whether there is an abnormal circumstance at the connection between the apparatus and the unit side circuit, based on the electrical potential or electrical current at the second terminal when the first electrical current is applied;

apply a second electrical current, which is sufficient to melt and blow the fuse, between the first terminal and the second terminal via the unit side circuit so that the second electrical current flows in the fuse when an abnormal circumstance of the connection is not detected; and provide information about the detected abnormal circumstance of the connection.

2. The apparatus according to claim 1, wherein the unit side circuit further includes a first resistor connected to the fuse parallely, the apparatus further comprises:

an electric power supply electrically connected to the first terminal; and a second resistor having one end electrically connected to the second terminal, the hardware processor controls an output of the electric power supply to the first terminal, so that the first electrical current flows in the fuse, and the hardware processor further controls the output of the electric power supply to the first terminal, so that the second electrical current flows in the fuse.

3. The apparatus according to claim 2, further comprising:

a switching device parallely connected to the second resistor, a fuse determining unit to determine whether the fuse melted and blew or not, based on electrical potential or electrical current of the second terminal, interrupting electrical current which flows in the switching device, in case an abnormal circumstance is not detected, and a melting and blowing unit to make the fuse melt and blow, flowing electrical current in the switching device, applying current by the hardware processor, in case that the fuse determining unit determined that the fuse does not melt and blow.

4. The apparatus according to claim 3, further comprising:

an acquiring unit to acquire information relates to the unit, based on the electrical potential or electrical current at the second terminal, interrupting electrical current which flows in the switching device, in case that the melting and blowing unit made the fuse melt and blow.

5. The apparatus according to claim 2, wherein the unit side circuit further includes a third resistor having one end electrically connected to the first terminal, the apparatus further comprises:

a third terminal electrically connected to the other end of the third resistor; and a forth resistor connected to the third terminal, wherein the hardware processor detects presence of the abnormal circumstance at connection of the unit side circuit, further based on electrical potential or electrical current at the third terminal, flowing current by the first current applying unit, the apparatus further comprises an acquiring unit to acquire information relates to the unit, based on electrical potential or electrical current at the third terminal.

6. The apparatus according to claim 5, wherein the electrical conductor is placed around each of the first, the second, and the third terminals, and the hardware processor detects presence of the abnormal circumstance of connection between the apparatus and the unit side circuit at each of the first, the second and the third terminals, and whether the unit is attached to the apparatus, further based on electrical potential or electrical current at the first terminal, flowing current by the first current applying unit.

7. The apparatus according to claim 6, wherein the hardware processor informs a terminal at which there is the abnormal circumstance or an unloaded state of the unit on the apparatus, in case that the hardware processor detects that there is the abnormal circumstance of connection at one of the first, the second and the third terminals, or in case that the hardware processor detects that the unit side circuit and the apparatus are not connected.

8. The apparatus according to claim 1, wherein the hardware processor increases the first electrical current in the fuse little by little.

9. The apparatus according to claim 8, wherein the hardware processor detects that there is an abnormal circumstance of connection, in case that the first electrical current flowing in the fuse controlled by the hardware processor reaches the first value, and electrical potential or electrical current at the second terminal does not reach the second value.

10. The apparatus according to claim 1, wherein the first electrical current that flows in the fuse is constant, and the second electrical current that flows in the fuse is constant.

11. The apparatus according to claim 1, wherein the apparatus is an image forming apparatus, and the unit is a consumable unit used for image forming.

12. A method of controlling an apparatus attaching a detachable unit equipped with a unit side circuit including a fuse, wherein the apparatus comprises first and second terminals; and an electrical conductor placed around at least the second terminal, the method comprises the processes to:

apply a first electrical current between the first terminal and the second terminal via the unit side circuit, so that the first electrical current, which is insufficient to melt and blow the fuse, flows in the fuse;

detect whether there is an abnormal circumstance at the connection between the apparatus and the unit side circuit, based on the electrical potential or electrical current at the second terminal when the first electrical current is applied;

apply a second electrical current between the first terminal and the second terminal via the unit side circuit, so that the second electrical current, which is sufficient to melt and blow the fuse, flows in the fuse when an abnormal circumstance of the connection is not detected; and provide information about the detected abnormal circumstance of the connection.

13. A non-transitory computer-readable recording medium encoded with a control program for an apparatus attaching a detachable unit, wherein the apparatus attaches a detachable unit equipped with a unit side circuit including a fuse, the apparatus comprises first and second terminals; and an electrical conductor placed around at least ef-the second terminal, and the control program is configured to cause a computer to execute the processes to:

apply a first electrical current between the first terminal and the second terminal via the unit side circuit, so that the first electrical current, which is insufficient to melt and blow the fuse, flows in the fuse;

detect whether there is an abnormal circumstance at the connection between the apparatus and the unit side circuit, based on the electrical potential or electrical current at the second terminal when the first electrical current is applied;

apply a second electrical current between the first terminal and the second terminal via the unit side circuit, so that the second electrical current, which is sufficient to melt and blow the fuse, flows in the fuse when an abnormal circumstance of the connection is not detected; and provide information about the detected abnormal circumstance of the connection.

14. The apparatus according to claim 1, wherein the hardware processor is further configured to:

determine whether or not the fuse has melted and blown while the second electrical current flows in the fuse; and wherein when the fuse has not melted and blown, melt and blow the fuse by flowing electrical current, which is larger than the second electrical current, in the fuse.

15. The method according to claim 12, further comprising:

determining whether or not the fuse has melted and blown while the second electrical current flows in the fuse; and wherein when the fuse has not melted and blown, melting and blowing the fuse by flowing electrical current, which is larger than the second electrical current, in the fuse.

16. The non-transitory computer-readable recording medium according to claim 13, further comprising:

determining whether or not the fuse has melted and blown while the second electrical current flows in the fuse; and wherein when the fuse has not melted and blown, melting and blowing the fuse by flowing electrical current, which is larger than the second electrical current, in the fuse.

* * * * *